US005282907A

United States Patent [19]

Liu et al.

[11] Patent Number: 5,282,907

[45] Date of Patent: Feb. 1, 1994

[54] TWO-PHASE CHROMIUM-NIOBIUM ALLOYS EXHIBITING IMPROVED MECHANICAL PROPERTIES AT HIGH TEMPERATURES

[75] Inventors: Chain T. Liu, Oak Ridge, Tenn.; Masao Takeyama, Tokyo, Japan

[73] Assignee: Martin Marietta Energy Systems, Inc.

[21] Appl. No.: 915,096

[22] Filed: Jul. 16, 1992

[51] Int. Cl.[5] ..... C22C 27/00

[52] U.S. Cl. ..... 148/423; 420/428

[58] Field of Search ..... 148/423; 420/428

[56] References Cited

U.S. PATENT DOCUMENTS 3,008,854 11/1961 Grant et al. ..... 420/428

OTHER PUBLICATIONS

J. Less-Common Metals, 3 (1961) 44.

Microstructure and mechanical properties of Laves--phase alloys based on $Cr_2Nb$ M. Takeyama and C. T. Liu, Materials Science and Engineering, A132 (1991) 61-66.

*Primary Examiner*—Upendra Roy

*Attorney, Agent, or Firm*—Luedeka, Hodges, Neely & Graham

[57] ABSTRACT

The specification discloses chromium-niobium alloys which exhibit improved mechanical properties at high temperatures in the range of 1250° C. and improved room temperature ductility. The alloys contain a $Cr_2Nb$-rich intermetallic phase and a Cr-rich phase with an overall niobium concentration in the range of from about 5 to about 18 at. %. The high temperature strength is substantially greater than that of state of the art nickel-based superalloys for enhanced high temperature service. Further improvements in the properties of the compositions are obtained by alloying with rhenium and aluminum; and additional rare-earth and other elements.

8 Claims, 8 Drawing Sheets

TWO-PHASE CHROMIUM-NIOBIUM ALLOYS EXHIBITING IMPROVED MECHANICAL PROPERTIES AT HIGH TEMPERATURES

The United States Government has rights in this invention pursuant to contract No. DE-AC05-84OR21400 awarded by the United States Department of Energy to Martin Marietta Energy System, Inc.

The present invention relates to compositions containing chromium and niobium and, more particularly, relates to a two-phase chromium-niobium alloy which exhibits improved strength and ductility.

It is known that the thermal efficiency of heat engines and energy conversion systems increases with increasing operating temperature. However, many advanced engines and energy systems have to operate at less than optimal temperatures due to the fact that the strength of currently available structural materials decreases sharply above 800° C. Nickel-based superalloys have been used marginally in high temperature applications up to 1000° C., but they deteriorate fairly rapidly under such conditions. They do not appear useful under the extreme service conditions associated with advanced designs operating at temperatures in the neighborhood of and above 1000° C.

The intermetallic alloy $Cr_2Nb$ has attracted attention for high temperature use (above 900° C.) because of its high melting temperature (about 1770° C.), low density (approximately 7.7 g/cm$^3$) and resistance to corrosion. However, the $Cr_2Nb$ phase exhibits relatively poor room temperature ductility and its fracture toughness at high temperatures is undesirably low.

Accordingly, it is an object of the present invention to provide a metallic composition for high temperature structural applications.

Another object of the invention is to provide an intermetallic alloy based on $Cr_2Nb$ for structural applications at high temperatures.

A further object of the invention is to provide an intermetallic alloy based on $Cr_2Nb$ which exhibits improved mechanical properties for high temperature structural use.

Still another object of the invention is to provide a $Cr_2Nb$-based alloy which exhibits improved room temperature ductility and high temperature fracture toughness.

Having regard to these and other objects, the present invention relates to a chromium-niobium alloy containing a $Cr_2Nb$ phase and a Cr-rich phase, the composition having an overall niobium concentration of from about 5 to about 18 atomic percent (at. %). Alloys according to the invention exhibit improved mechanical properties in the cast condition and, in particular, are found to exhibit improved strength at high temperatures in the neighborhood of 1000° C. and improved ductility at ambient temperatures.

It is preferred to incorporate from about 0.5 to about 4 at. % aluminum and less than about 1% Y, Hf, Ta and V in the alloy of the invention in order to enhance its resistance to oxidation and corrosion. Further improvements in the properties of the alloy may be achieved through addition of from about 1 to about 10 at. % rhenium which enhances the strength and toughness through a range of temperatures. A particularly preferred composition in accordance with the invention consists essentially of about 12 at. % niobium, about 8 at. % rhenium, about 4 at. % aluminum and the balance chromium.

The above and other features and advantages of the invention will now be described in further detail with reference to the drawings in which:

FIG. 1 is a graphical view illustrating a relationship between room temperature hardness and niobium concentration for two-phase $Cr_2Nb$ alloys;

FIGS. 2(*a*) and 2(*b*) are photomicrographs at 650 X showing cross-sections of $Cr_2Nb$-Cr alloys containing 12 and 6 at. % Nb, respectively, in the as-cast condition and FIGS. 2(*c*) and 2(*d*) are photomicrographs of the same respective alloys showing their structures after a 5 day anneal at 900° C.;

Figure 6A:
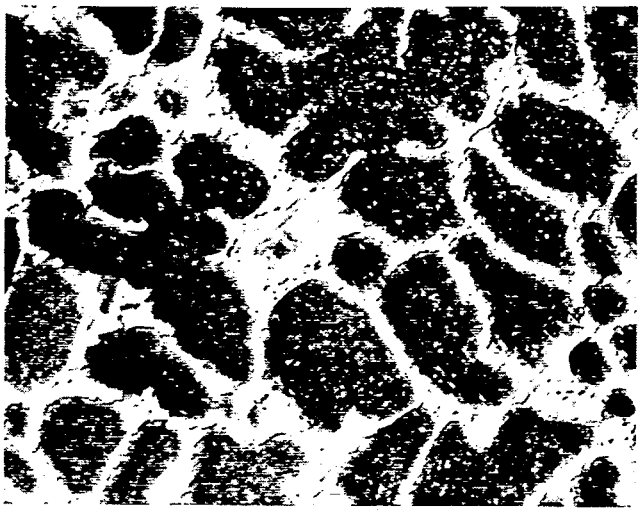
Figure 6B:
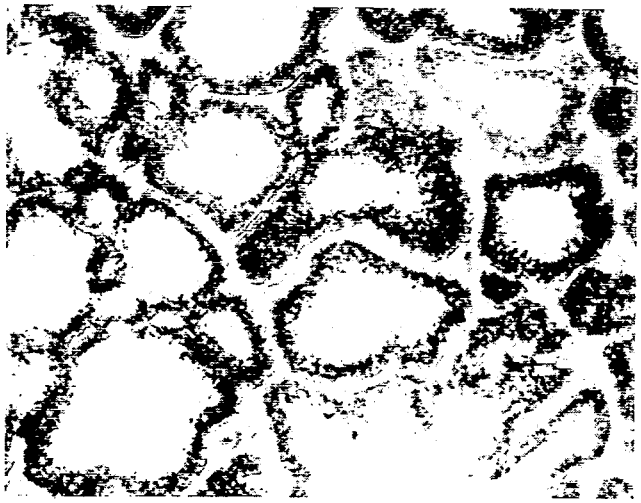
Figure 7:
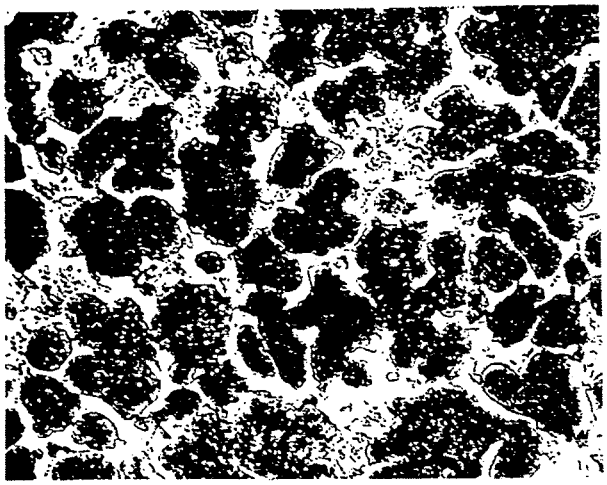
Figure 7:
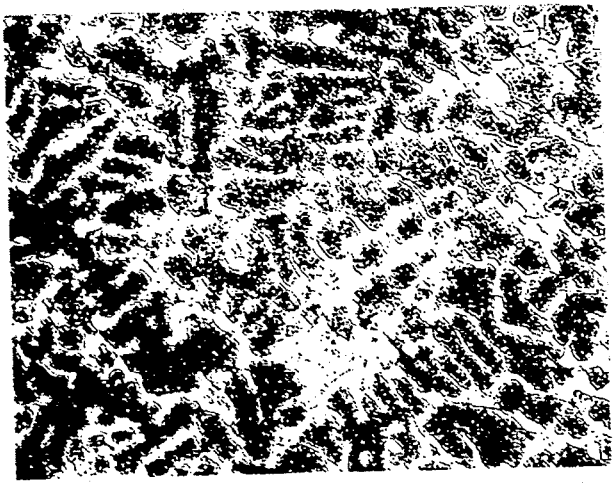
Figure 8A:
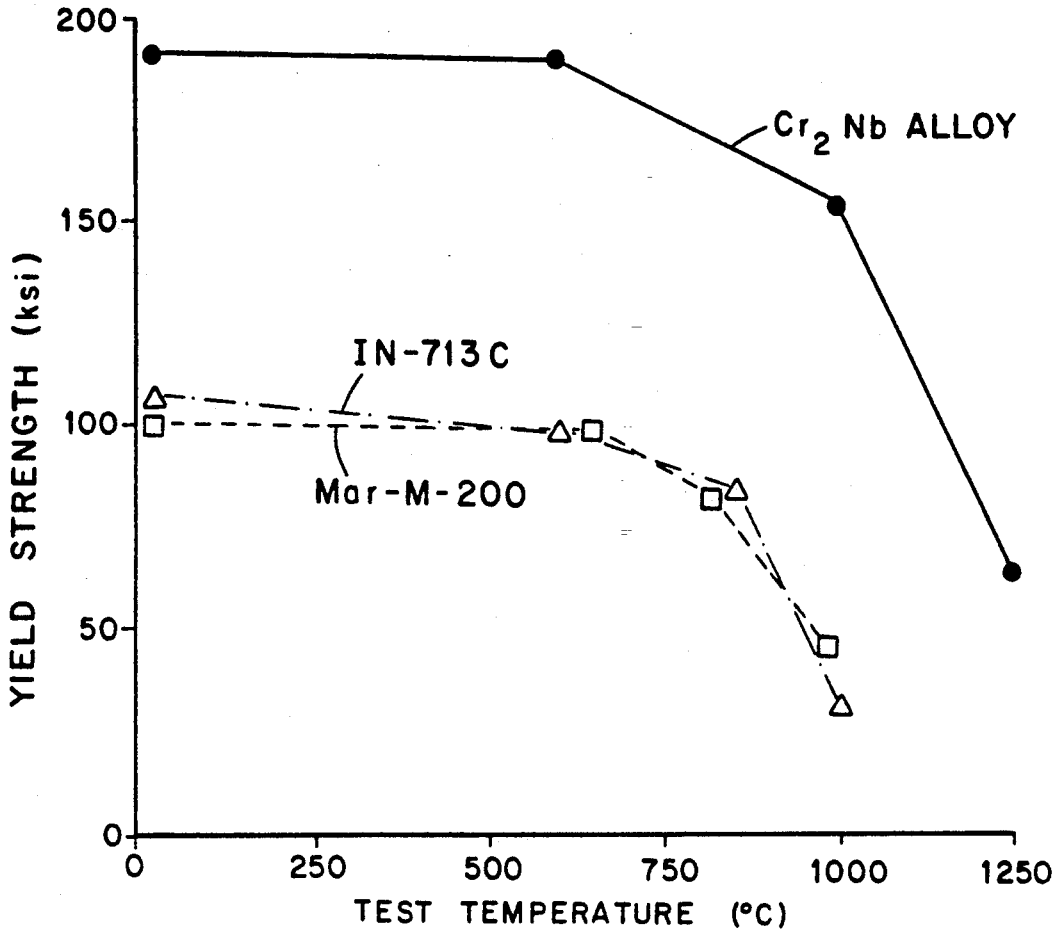
Figure 8B:
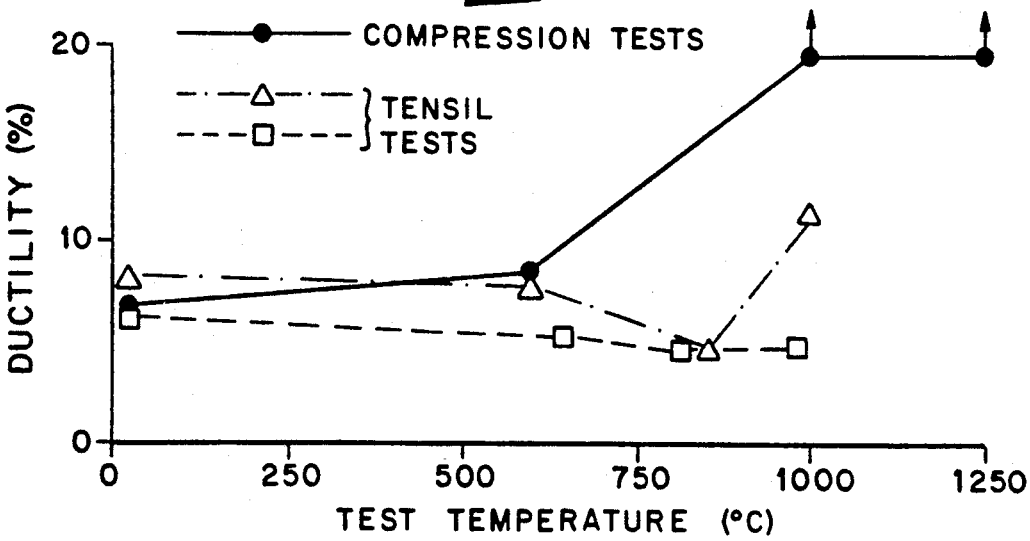

FIGS. 6(*a*) and 6(*b*) are photomicrographs at 650 X showing cross-sections of $Cr_2Nb$-Cr alloys containing 12 and 6% Nb, respectively, each alloyed with 8% Re and annealed at 900° C. for 5 days;

FIGS. 7(*a*) and 7(*b*) are photomicrographs at 650 X showing cross-sections of $Cr_2Nb$ alloys containing 12 at. % Nb alloyed with 4% Re and a combination of 4% Re and 2% Al, respectively, after a 5 day anneal at 900° C.; and FIGS. 8(*a*) and 8(*b*) are graphical views showing the yield strengths and ductilities, respectively, of chromium-niobium alloys and several commercially available cast alloys (IN-713C, Mar-M-200).

Figure 1:
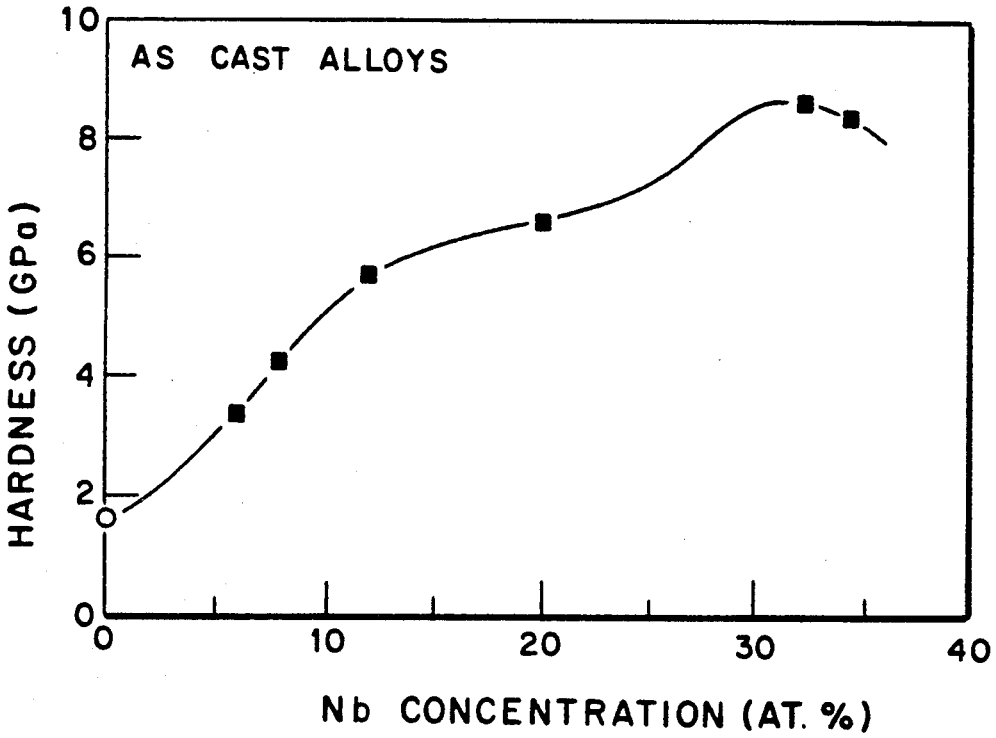

The invention may be generally described as a two-phase chromium-niobium alloy containing a $Cr_2Nb$ intermetallic phase and a Cr-rich phase. The $Cr_2Nb$ phase appears to act as a strengthener phase and the Cr-rich phase appears to act as a softener. Microscopic examination indicates that eutectic compositions of the Cr-$Cr_2Nb$ system have 17 at. % Nb. As shown in FIG. 1, in the two-phase region; i.e., below about 30 at. % niobium, the room temperature harness of chromium-niobium alloys generally decreases with decreasing niobium concentration. For high temperature structural use, the hardness should be between about 4 GPa and 6 GPa. Thus, the overall niobium concentration in the composition should be between about 5% to about 18%. This niobium will, of course, be distributed between the two phases.

Figure 2:
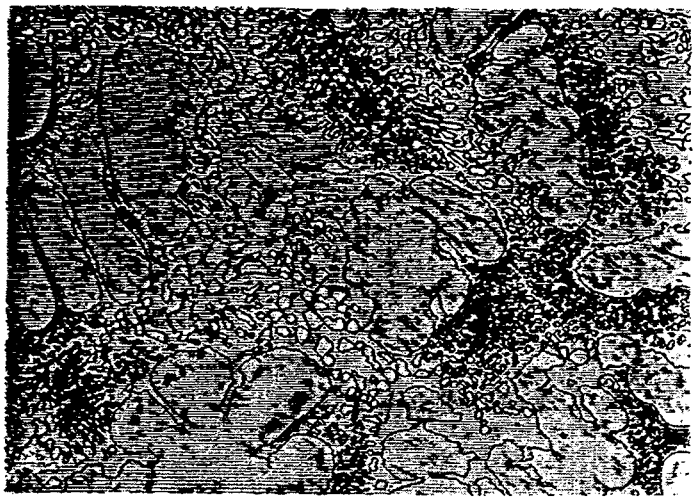
Figure 2:
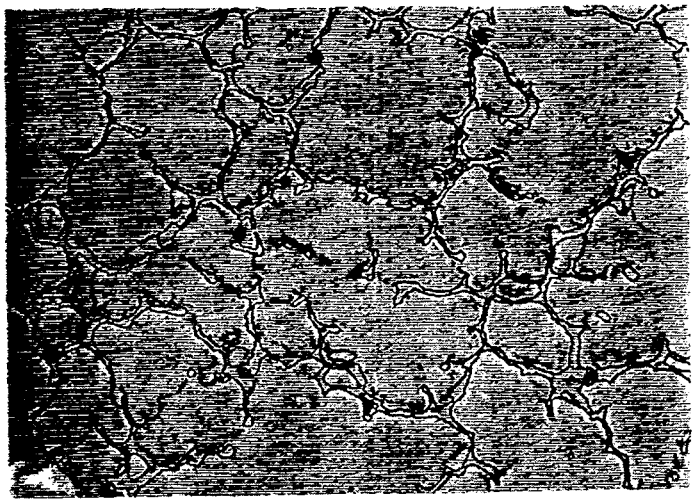
Figure 2:
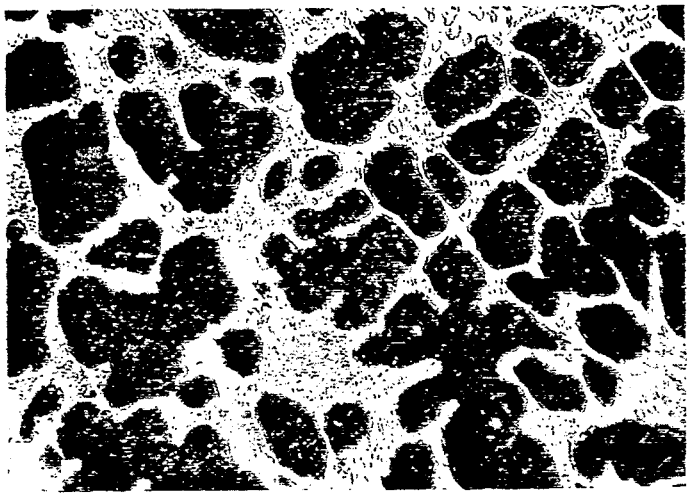
Figure 2:
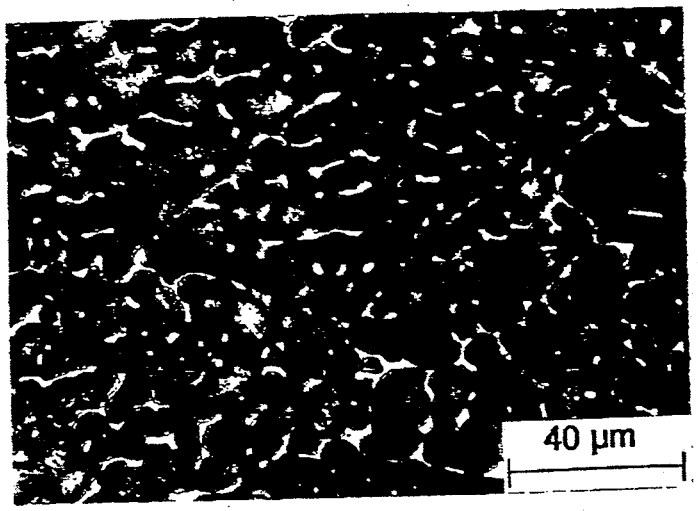

To characterize microstructures, $Cr_2Nb$/Cr alloys containing 6 and 12 at. % Nb were encapsulated in an evacuated quartz capsule and heated at 900° C. for 5 days. FIGS. 2(*a*)–2(*d*) show the microstructures of the two alloys in the as-cast and annealed conditions. As shown in FIG. 2(*a*), the as-cast Cr-12% Nb alloy exhibited patches of the chromium-rich phase surrounded by the eutectic matrix indicating a hypoeutectic structure. The dark spots in the Cr-rich patches appear to be $Cr_2Nb$ particles formed during cooling. As shown in FIG. 2(*b*), the Cr-6% Nb alloy in the as-cast condition contained Cr-rich patches over most areas and a small amount of the $Cr_2Nb$ phase interdispersed as a network through the Cr-rich patches. As shown in FIGS. 2(*c*) and 2(*d*), the primary Cr-rich regions turn dark after annealing.

Figure 3:
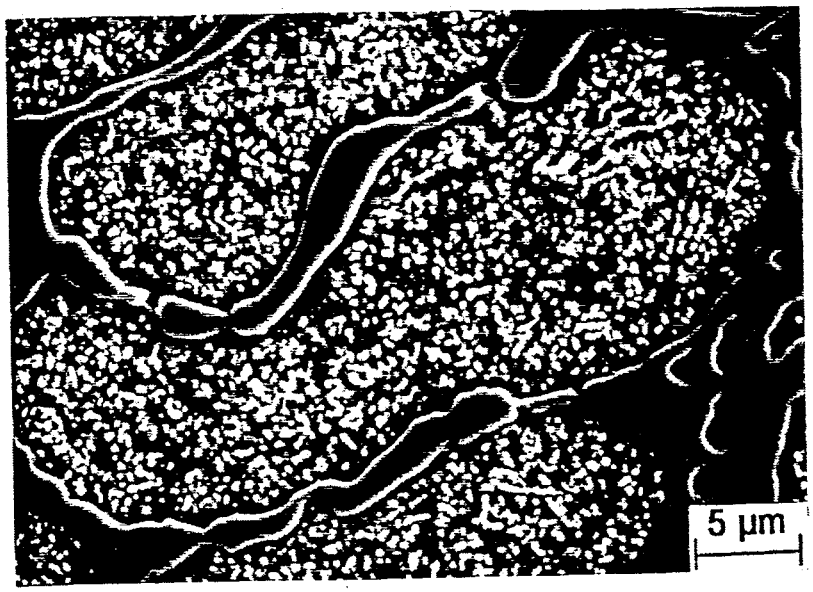
FIG. 3 is an electron scanning image at 3000 X showing a cross-section of a $Cr_2Nb$/Cr alloy containing 12 at. % Nb annealed at 1100° C. for 100 hours.

A microstructure of Cr-rich patches in the Cr-12% Nb alloy annealed at 1000° C. for 1 hour is shown in FIG. 3. Numerous fine particles (<1 μm) are clearly visible in this region. The precipitates were identified as a $Cr_2Nb$ phase. The precipitation of $Cr_2Nb$ after annealing is believed to result from a decrease in the solubility of niobium in the Cr-rich phase from about 5 at. % at the eutectic temperature (1620° C.) to 1.7% at 1100° C.

Figure 4:
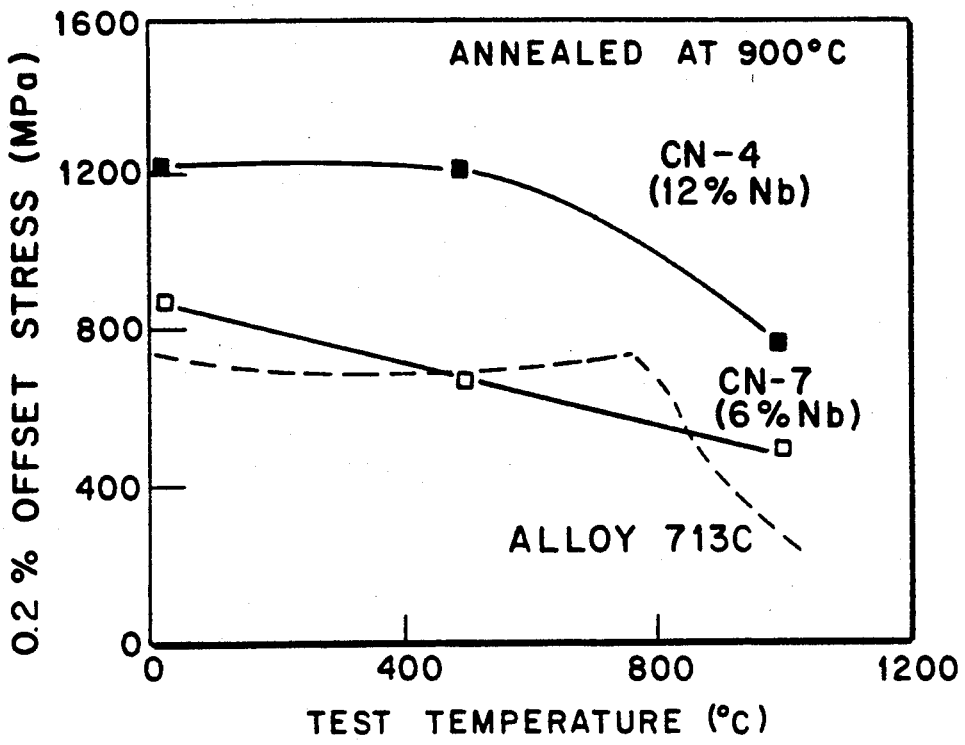
FIG. 4 is a graphical view showing the yield strengths of chromium-niobium alloys and a commercial cast alloy (alloy 713C) as a function of temperature.
Figure 5:
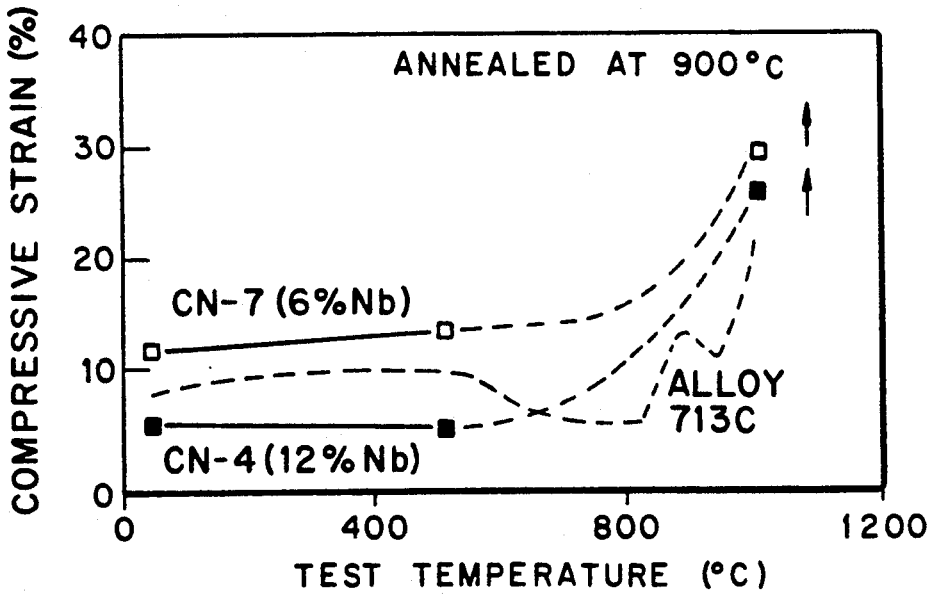
FIG. 5 is a graphical view showing compressive strain of chromium-niobium alloys and a commercial cast alloy as a function of temperature.

The compressive properties as a function of temperature for 12 and 6 at. % Nb two-phase alloys according to the invention (CN-4 and CN-7 respectively) are compared with a commercial cast super alloy IN-713C (Ni-12.5Cr-6.1A1-4.2 Mo-2Nb-0.8T-0.1Zr-0.12C, wt %) in FIGS. 4 and 5. This data shows that the room temperature yield strengths (offset stress) of 6 and 12 at. % niobium alloys were above 800 MPa (116 ksi)and 1200 MPa (174 ksi), respectively, and decreased moderately with increasing temperature. Even at 1000° C., the 12% niobium alloy exhibited a yield strength of about 800 MPa, which is substantially stronger than conventional nickel-based superalloys. For example, the yield strength of IN-713C at 1000° C. was about 300 Mpa(43.5 ksi). The compressive strain, on the other hand, of 6 and 12% niobium alloys is about 11 and 5% at room temperature, respectively, and remained almost unchanged up to about 500° C. At 1000° C., both alloys could be deformed extensively with compressive ductilities larger than 25%.

Tables 1 and 2 show the mechanical properties of 6 and 12 at. % niobium two-phase compositions according to the invention at room temperature and 1000° C. including data for alloys containing additions of aluminum (Al), rhenium (Re), tantalum (Ta), vanadium (V), yttrium (Y) and hafnium (Hf). All of the alloys were prepared by arc melting and drop casting. Of course, the alloys may be also prepared by powder metallurgy or directional solidification generally used for processing of Ni-based superalloys.

TABLE 1

Mechanical properties[a] of CN-4 and CN-7 type alloys tested in compression at room temperature and 1000° C.

| Alloy number (Composition in at. %) | Yield strength (ksi) | Ultimate strength (ksi) | Compressive elongation (%) |
|---|---|---|---|
| | Room temperature | | |
| CN-4 (Cr-12 Nb) | 156 | 233 | 4.0 |
| CN-4T (Cr-12 Nb-2 Ta) | 191 | 257 | 5.8 |
| CN-4V (Cr-12 Nb-8 V) | 228 | 332 | 7.0 |
| CN-4A (Cr-12 Nb-8 Al) | 232 | 337 | 5.6 |
| CN-4R (Cr-12 Nb-8 Re) | 237 | 371 | 8.4 |
| CN-7 (Cr-6 Nb) | 126 | 265 | 11.4 |
| CN-7F (Cr-6 Nb-8 Fe) | 144 | 280 | 25.0 |
| CN-7N (Cr-6 Nb-8 Ni) | 153 | 289 | 14.9 |
| CN-7T (Cr-6 Nb-2 Ta) | 164 | 296 | 15.8 |
| CN-7V (Cr-6 Nb-8 V) | 134 | 275 | 17.1 |
| CN-7A (Cr-6 Nb-8 Al) | 161 | 292 | 12.5 |
| CN-7R (Cr-6 Nb-8 Re) | 147 | 328 | 19.5 |
| | 1000° C. | | |
| CN-4 | 105 | 142 | >28 |
| CN-4T | 117 | 156 | 22.3 |
| CN-4V | 122 | 248 | 17.8 |
| CN-4A | 143 | 177 | 31.3 |
| CN-4R | 164 | 238 | 24.8 |
| CN-7 | 72.3 | 96.7 | >30 |
| CN-7F | 51.7 | 84.0 | >31 |
| CN-7N | 57.6 | 94.0 | >32 |
| CN-7T | 77.6 | 130.0 | >30 |
| CN-7V | 69.0 | 117.0 | >32 |
| CN-7A | 85.7 | 149.0 | >32 |
| CN-7R | 97.8 | 173.0 | 29.7 |

[a]All specimens were annealed for 5 d at 900° C.

Table 1 shows that additions of Al, Re, Ta, V, Y, and Hf improve the yield strength of the cast compositions based on 12 at. % Nb at both room temperature and 1000° C. For these additions, Re appears to be the most effective followed by Al in improving yield and ultimate strengths, and in improving room-temperature ductility. Addition of rhenium increases the yield and ultimate strength by about 60% at 1000° C. Table 1 further shows that the compositions based on 12 at. % Nb are generally stronger than the compositions based on 6 at % Nb. The room temperature ductility of the 12 at. % Nb compositions is somewhat lower than that of the 6 at. % Nb, but is acceptable for structural applications.

The microstructures of the alloys from Table 1 were studied for compositions annealed at 900° C. for 5 days. Cross-sections of the alloys CN-4R and CN-7R are shown in FIGS. 6(*a*) and 6(*b*) at 650 X. They are representative of the microstructures of the other CN-4 and CN-7 alloys. For CN-4R, dark patches of the Cr-rich phase are surrounded by the matrix of the eutectic structure containing $Cr_2Nb$ as a major phase and a minor Cr-rich phase. The annealing produced precipitation of fine $Cr_2Nb$ particles in the primary patches which give the dark contrast. Annealing at 1000° C. produced about the same structure for both CN-4 and CN-7-type alloys. It appears that alloying affects the relative amount of eutectic phase and the primary Cr-phase. Vanadium and Ta appear to increase the eutectic phase. Rhenium and aluminum appear to decrease the eutectic phase.

Since Re and Al appear to be the most effective overall in improving strength and ductility, additional alloys containing rhenium and aluminum were prepared to determine their optimum concentrations in the base 12% Nb alloy. A small amount of Y or Hf was added to control oxidation. Table 2 shows the compressive properties of these alloys together with the base alloy at room temperature, 600° C., 1000° C., and 1250° C.

TABLE 2

Mechanical properties of CN-40 and CN-43 based on CN-4 alloy

| Alloy number (composition at. %) | Yield strength (ksi) | Ultimate strength (ksi) | Compressive elongation (%) |
|---|---|---|---|
| | Room temperature | | |
| CN-4[a] (Cr-12% Nb) | 156 | 233 | 4.0 |
| CN-40[b] (Cr-12% Nb-4% Re | 195 | 302 | 6.9 |
| CN-43[b] (Cr-12% Nb-4% Re-2% Al) | 191 | 264 | 6.6 |
| | 600° C. | | |
| CN-4[a] | — | — | — |
| CN-40[b] | 155 | 261 | 9.8 |
| CN-43[b] | 192 | 254 | 8.6 |
| | 1000° C. | | |
| CN-4[a] | 105 | 142 | >28 |
| CN-40[b] | 126 | 189 | ~33 |
| CN-43[b] | 158 | 221 | ~32 |
| | 1250° C. | | |
| CN-4[a] | — | — | — |
| CN-40[b] | 63.0 | 84.7 | >30.7 |
| CN-43[b] | 67.3 | 90.2 | >30.6 |

[a]Annealed for 5 d at 900° C.
[b]Amended for 4 d at 1000° C. plus 5 d at 900° C.

As can be seen from the data of Table 2, both CN-40 and CN-43 were substantially stronger at all test temperatures and were more ductile at room temperature. The alloy CN-43 containing a combination of 4 at. % Re and 2 at. % Al was significantly stronger than CN-40 at elevated temperatures. This alloy showed a yield strength of 464 MPa (67.3 ksi) and an ultimate strength of 621 MPa (90.2 Ksi) at 1250° C. The ductility of these alloys is not particularly sensitive to alloy composition at elevated temperatures.

FIGS. 7(*a*) and 7(*b*) show the microstructures of CN-40 and CN-43. These photographs demonstrate that addition of aluminum to the 4% Re alloy refines the grain structure.

FIGS. 8(*a*) and 8(*b*) compare the mechanical properties of CN-43 with those of commercial state of the art cast alloys such as Mar-M 200 (Ni-9.0Cr-10.0Co-12.5W-1.0Nb-2.0Ti-5.0Al-0.13C, wt %) and IN 713C (described previously). The comparison shows that the CN-43 alloy is substantially stronger than these commercial alloys. At 1000° C., the strength of CN-43 was higher by more than 200%. The CN-43 alloy exhibits reasonably good ductility in compression at room temperature and its ductility increases sharply with temperature above 600° C.

The oxidation resistance of CN-4 alloys was evaluated by exposure to air at 1000° C. The specimens were periodically removed from a furnace and cooled to room temperature for weight measurement. The alloys exhibited some degree of spalling during cooling. Table 3 shows the weight gain of CN-4, −40, and −43 after about 200 h of exposure, from which it can be seen that the alloy CN-43 containing 4% Re, 2% Al, and 0.03% Y had the lowest weight gain.

TABLE 3

Oxidation resistance of CN alloys air exposed at 1000° C. for 200 h

| Alloy | Composition (at. %) | wt gain ($10^{-2}$ g/cm$^2$) |
|---|---|---|
| CN-4 | Cr-12Nb | 9.7 |
| CN-40 | Cr-12Nb-4Re | 7.7 |
| CN-43 | Cr-12Nb-4Re-2Al-0.03Y | 4.2 |

It is thus seen from the foregoing that the mechanical and metallurgical properties of chromium-niobium alloys are substantially improved in the two-phase $Cr_2Nb$/Cr alloys of the invention containing 5 to 18 at. % Nb and that the properties of the two-phase alloys are further improved by alloying with 1 to 10 at. % Re or aluminum. A preferred composition comprises chromium and niobium distributed as a $Cr_2Nb$ phase and a Cr-rich phase with an overall niobium content of 5 to 14 at. % alloyed with 1 to 8 at. % Re and 0.5 to 4 at. % Al. A particularly preferred composition contains the $Cr_2Nb$/Cr-rich phases with an overall niobium content of about 12 at. %, about 4 at. % Re and about 2 at. % Al. Small amounts (≦1%) of other elements including V, Ta, Hf/Zr, and Y may further improve the properties of $Cr_2Nb$/Cr(Nb) alloys.

The alloys of the invention are much stronger at high temperatures than state-of-the-art nickel-based superalloys. As a result, the potential uses for chromium-niobium compositions in the cast condition are expanded so that the beneficial properties of the compositions may be realized in a wider range of applications. The compositions of the invention may be prepared by standard procedures including melting and casting or other manufacturing techniques such as powder metallurgy, directional solidification, and single-crystal growth processes.

Although preferred embodiments of the invention have been described in the foregoing detailed description, it will be understood that the invention is capable of numerous rearrangements, substitutions, modifications and the like without departing from the scope and spirit of the following claims.

What is claimed is:

1. A chromium-niobium composition comprising a $Cr_2Nb$ phase Cr-rich phase with an overall Nb content of about 12 at. % having about 4 at. % Re and about 2 at. % Al, whereby the composition exhibits substantially improved high temperature strength as compared to commercially available alloys for enhanced high temperature service.

2. A chromium-niobium composition comprising a $Cr_2Nb$-phase and a Cr-rich phase consisting essentially of an overall Nb content of from about 5 to about 18 at. %, from about 1 to about 10 at. % Re and from about 0.5 to about 10 at. % aluminum.

3. The composition of claim 2 containing about 12 at. % Nb, about 4 at. % Re and about 2 at. % Al.

4. The composition of claim 2 containing a minor addition of at least one element selected from the class consisting of V, Ta, Hf/Zr, and Y.

5. A chromium-niobium composition consisting of a $Cr_2Nb$-phase and a Cr-rich phase with an overall Nb content of from about 5 to about 18 at. %, from about 1 to about 10 at. % Re, from about 0.5 to about 10 at. % Al and up to about 1 at. % of any of the elements selected from the class consisting of V, Ta, Hf/Zr, and Y.

6. A chromium-niobium composition comprising a $Cr_2Nb$ phase and a Cr-rich phase with an overall Nb content ranging from about 5 to about 18 at. % and from about 0.5 to about 10 at. % of at least one element selected from the class consisting of rhenium and aluminum wherein the composition exhibits substantially improved strength at temperatures of about 1000° C. as compared to commercially available alloys for enhanced high temperature service.

7. The composition of claim 6, wherein both rhenium and aluminum are present and the rhenium content is from about 1 to about 8 at. % and the aluminum content 0.5 to about 4 at. %.

8. The composition of claim 6, wherein both rhenium and aluminum are present and the niobium content is about 12 at. %, the rhenium content is about 4 at. % and the aluminum content is about 2 at. %.

* * * * *